US006162491A

United States Patent [19]

Bertini

[11] Patent Number: 6,162,491

[45] Date of Patent: Dec. 19, 2000

[54] METHOD OF SUPPRESSING SUPERSATURATION IN UNDERGROUND ELECTRICAL CABLES

[75] Inventor: Glen J. Bertini, Tacoma, Wash.

[73] Assignee: UTILX Corporation, Kent, Wash.

[21] Appl. No.: 09/400,739

[22] Filed: Sep. 21, 1999

Related U.S. Application Data

[60] Provisional application No. 60/101,381, Sep. 22, 1998.

[51] Int. Cl.[7] ..... B05D 5/12

[52] U.S. Cl. ..... 427/117; 427/118; 427/8; 427/387

[58] Field of Search ..... 427/8, 117, 118, 427/387; 174/25 R, 25 C, 25 P, 110 S

[56] References Cited

U.S. PATENT DOCUMENTS

| | | | |
|---|---|---|---|
| 4,299,713 | 11/1981 | Maringer et al. . | |
| 4,354,992 | 10/1982 | Bahder | 264/85 |
| 4,372,988 | 2/1983 | Bahder . | |
| 4,766,011 | 8/1988 | Vincent et al. . | |
| 4,840,983 | 6/1989 | Vincent | 524/265 |
| 4,845,309 | 7/1989 | Vincent et al. . | |
| 4,945,653 | 8/1990 | Eager, Jr. et al. | 34/21 |
| 4,961,961 | 10/1990 | Vincent et al. . | |
| 4,978,694 | 12/1990 | Vincent et al. | 523/173 |
| 5,200,234 | 4/1993 | Bertini . | |
| 5,372,840 | 12/1994 | Kleyer et al. . | |
| 5,372,841 | 12/1994 | Kleyer et al. . | |

*Primary Examiner*—Brian K. Talbot

*Attorney, Agent, or Firm*—Christensen O'Connor; Johnson Kindness PLLC

[57] ABSTRACT

A method for enhancing the dielectric properties of an electrical cable having a central stranded conductor encased in a polymeric insulation. The cable defines an interstitial void space ($v_1$) between the strands of the conductor. The volume ($v_2$) of a dielectric enhancement fluid required to be absorbed by the cable to reach a predetermined level of dielectric enhancement is determined. The ratio of ($v_1/v_2$) is computed. If the ratio of ($v_1/v_2$) is greater than a maximum ratio of 1.4, then a quantity of the dielectric enhancement fluid is diluted with a sufficient quantity of a diluent to produce a mixture of diluent and dielectric enhancement fluid, such that when the volume ($v_1$) of the mixture is supplied to the cable interior, the cable will have been supplied with a volume ($v_3$) of the dielectric enhancement fluid within the mixture such that ($v_3/v_2$) is less than 1.4. The diluent is substantially insoluble in the polymeric insulation, has a sufficiently low initial viscosity to enable introduction into the cable interior, and is miscible with the dielectric enhancement fluid.

9 Claims, 3 Drawing Sheets

FILE NO.:00023210 CABLE FIELD REPORT TDR WAVEFORM?N

COSTOMER : TUEOD ►TU ELECT ODESSA
CONTRACT/PO : S0170639C UNITS: P=PSIG|L=FT|M=LBS
DIVISION/WORK ORDER :
DISTRICT/COUNTY/CITY : MIDLAND (MAP PAGE AND COORDINATE)
STREET/SUBDIVISION : UNIV GARDN
LOOP : WALL
RELEASED : 98/01/26 JOB GROUP : ► OPTIONAL CUSTOMER JOB GROUP
SERVICE REQ'D DATE : 98/02/25 *SEC. MODE : ►
ISSUED : HISTORY:
FLUID/PRODUCT : XL ►CABLECURE/XL
CABLE :100017500 MIN. SOAK= DAYS

| CABLECURE TRASK | FLOWMOLE TASK | CREW | INVOICE | BILLABLE |
|---|---|---|---|---|
| TESTING/ANALYSIS/SWITCH | | 95404 | | C5,C8 |
| INSTALL TERMNATIONS | | 95404 | | 81,C2-C3 |
| VACUUM TANK REMOVAL | REAM/PULLBACK | 95404 | | ALL OTHERS |
| DISCONNECT EQUIPMENT | TERMINATE/CUT-OVER | 95404 | | CD |
| MISCELLANEOUS CRAFTWORK PERFORMED ON | | | | C4 |

TERM 1 : SW-2 ADRRESS : 5000 HANOVER DR
TERM 1 : SW-3 ADRRESS : 4900 E UNIVERSITY
CABLE LENGTH : 1326 FT PHASE 1 OF 1 PHASES

TDR AND/OR AIR FLOW TESTED : 98/02/09 BY VHN

TDR FROM TERM : 1 NEUTRAL CONDITION : 1 ►LEVEL CORROSION (0-25%)
SPLICES CORROSION :
FLOW CHECK @ 50.0 PSIG TERM 1-2 $R_\infty$= 55CCM-OUTLET R= .90909PSI/CCM
PRESSURE CHECK @ 50.0 PSIG TERM 2-1 $R_\infty$= 55CCM-OUTLET R= .90909PSI/CCM INSTALL TERMS : 98/02/09 BY VHN
STARTED : 98/02/09 BY VHN FLOW FROM TERM : 1 FEED PRESSURE : 50.0 PSIG
THROUGH : 98/02/09 BY VHN SOAK FROM TERM : SOAK PRESSURE : PSIG
ENERGIZED/REMOVED : 98/02/09 BY VHN TARGET REMOVAL : 98/02/09

TREATMENT DATA

DESICCANT CONVERT : 1.09
FEED CONVERT : 1.09
VACUUM CONVERT : 1.09

DESICCANT START : 12.0
DESICCANT END : 3.0
FEED TANK START : 100.0
FEED ADDED :
VACUUM DISCARD : 22.0
INJECTION END : 2.0
SOAK ADDED :
SOAK END : 2.0

FEED
MINIMUM DISCARD=9.9
SOAK
EXPECTED END -OF-SOAK=-18.2

FLUID USAGE-LBS

| | THEORY | ACTUAL |
|---|---|---|
| DESICCANT | 9.28 | 9.81 |
| INJECTON | 92.83 | 92.65 |
| SOAK | 22.02 | |
| DISCARD | | 23.98 |

FLUID NOTES :

CUSTOMER APPROVAL : ACTIVE/00023210

Fig. 1.

4. Test results for OG & E Micro IR.

CABLE GEOMETRY
DATA SHEET

AWG CONDUCTOR SIZE : 1000 CODE : 00 UNIQUE CABLE CODE : 100017500
EXTRUDED CONDUCTOR SHIELD ? Y (OR TAPED) LAYERED CONSTRUCTION ? Y (OR BUNDLED)
INSULATION THICKNESS (MILS) : 175 (NOMINAL) ACTUAL : 198MILS
CONDUCTOR SHIELD : 31MILS INSULATION SHIELD ; 43MILS
NUMBER OF STRANDS : 61 STRAND OD : 0.1280" LAYERS OF STRANDS : 5
INSULATION : PE VOLTAGE RATING : 15KV SOAK TIME : ___DAYS

| | MEASURED | CALCULATED | |
|---|---|---|---|
| CONDUCTOR OD : | 1.1250" | 1.1520" | (FROM STRAND OD) |
| INSULATION OD : | | 1.5830" | |
| INSULATION SHIELD OD : | 16.700" | 1.6690" | (CLOSURE CHECK) |
| STRAND COMPRESSION : | 1.00 | 0.95 | (FROM CONDUCTOR) |

| | -SOLUBILITIES- | | (LBS/1000 FT) -MASS ABSORPTION- | |
|---|---|---|---|---|
| | SILICONE | WATER | SILICONE | WATER |
| INTERSTITIAL ..... | | | 70.0 | |
| STRAND SHIELD..... | 16.0% | 1.0% | 14.283 | 0.893 |
| INSULATION..... | 4.0% | 0.1% | 14.837 | 0.371 |
| INSULATION SHIELD..... | 1.0% | 1.5% | 0.946 | 1.419 |

Fig. 3.

METHOD OF SUPPRESSING SUPERSATURATION IN UNDERGROUND ELECTRICAL CABLES

This application claims the benefit of the filing date of U.S. Provisional patent application Ser. No. 60/101,381, filed Sep. 22, 1998.

FIELD OF THE INVENTION

The present invention relates to methods of enhancing the dielectric strength of electrical distribution cables, and more particularly, preventing supersaturation in large diameter cables that are being treated with fluids for restoration of dielectric strength.

BACKGROUND OF THE INVENTION

It is a well-known phenomena that underground electrical distribution cables typically include an electrical conductor surrounded by a semi-conducting polymeric shield, which is then jacketed with a polymeric insulation jacket. The polymeric insulation jacket may then be further layered with a semi-conducting insulation shield, and finally, an outer polymeric protective jacket is typically applied over the insulation shield. The conductor may be stranded from multiple wires, or less commonly a solid conductor core may be utilized. It is a well-known phenomena that after such electrical distribution cables are buried in the ground for extended periods of time, the polymeric insulation jacket of the cable may undergo deterioration that reduces its dielectric properties and can lead to failure. This situation, which is particularly prevalent with polyolefin insulations, is referred to as electrochemical tree formation, and is caused by the diffusion of moisture into the polymeric insulation. This process can greatly reduce the useful life of electrical cables.

As a result, techniques have been developed for treating such installed cables with an anti-treeing agent that retards the entry of moisture into the insulation layer. A tree retardant or anti-treeing agent is typically a low-viscosity liquid that can be introduced into the interstitial voids assisting between the strands of a stranded conductor cable, which then diffuses out through the shielding and into the polymeric insulation jacket. Alternately, when a solid conductor is utilized, anti-treeing agents can be injected underneath the outer protective jacket and diffuses inwardly through the insulation jacket. Known techniques for treating cables in this manner are disclosed, for example, in U.S. Pat. Nos. 4,372,998 to Bahder and 5,372,840 to Kleyer et al., disclosures of which are hereby expressly incorporated by reference.

For large diameter cables (>500 kcm or >240 $mm^2$) with stranded wound or loose conductors, the amount of fluid that can fit in the interstices of the strands may exceed the amount of fluid required to optimally treat polymeric cables. Because these cables all have varying electrical loads in use, they exhibit corresponding resistive energy-induced temperature swings. As the temperature of the polymeric insulation varies, so too does the solubility of fluids (such as anti-treeing treatment fluids residing within the cable core and absorbed into any insulation jacket), and hence a condition of "supersaturation" can occur as the temperature cycles down. The fluid is forced from the polymeric phase of the insulation jacket and into tiny microvoids, which are created by the mechanical pressures resulting from the thermodynamic equilibrium associated with the change of phase from the anti-treeing fluid as it passes from being dissolved in the polymeric solid into a free liquid. During the next increase in temperature still more fluid is drawn into the polymeric phase, and the cycle repeats until the swell of the polymer reaches a point where the mechanical strain bursts the cable and it fails catastrophically.

The failure mechanism described above has been observed by the inventors in two classes of cases. In the first class, 750 kcm feeder cables were treated with an anti-treeing agent sold commercially by Utilx Corporation, Kent, Wash., under the trademark CableCURE 2-2614 (as disclosed in U.S. Pat. No. 4,766,011, issued to Vincent et al., the disclosure of which is hereby expressly incorporated by reference) fluid for a period from 1990 to 1991 at Arizona Public Service (APS). Reservoirs of fluid were left attached for 60 days as this was the standard practice for all cables treated prior to this time frame. The application to large diameter cables was new. A large number of these cables failed in-service due to the supersaturation mechanism described above. The procedure of leaving a pressurized soak bottle attached to cables larger than 3/0 in size was discontinued.

A second class of observations involved an experiment at Cable Technology Laboratories (CTL) undertaken on behalf of Orange & Rockland utilities. A 4/0 (relatively small) diameter cable was thermally cycled with a pressurized reservoir of CableCURE fluid attached. The cable failed as described above. In actual field application, no reservoir is attached to such a cable, so that there has not been a chance for such a failure mechanism if proper procedures are followed. The problem was thought to have been solved by eliminating the external pressurized reservoir.

Until the current unexpected problem, which is the inspiration for the present invention this procedural change solved the problem. While eliminating the pressurized reservoir was and is sufficient for many cables, certain large diameter conductors, especially those with thinner conductor shields and/or thinner insulation have experienced failure due to supersaturation. FIG. 1 is a Cable Field Report (CFI) for such a cable. The 1000 kcm cable was treated on Feb. 2, 1998 and failed on Jul. 30, 1998.

FIG. 2 is a micro-infrared spectrographic analysis of the cable described in FIG. 1, labeled Texas Utilities (TU.) 00023210. Four radial scans quantifying the anti-treeing agent sold commercially by Utilx Corporation under the trademark CableCURE/XL fluid (as disclosed in U.S. Pat. No. 5,372,841, issued to Kleyer et al., the disclosure of which is hereby expressly incorporated by reference) were taken (90° apart from each other and labeled $1^{st}$ Quarter through $4^{th}$ Quarter) from the conductor shield out to the insulation shield and are plotted. An insert of a well-treated cable labeled OG&E Cable Phase B is provided for comparison. The integrated quantity of fluid in the dielectric of the TU cable is approximately twice that of the OG&E cable.

The dilution of dielectric enhancement fluids (i.e., anti-treeing agents) has been proposed for other purposes. Bertini teaches in U.S. Pat. No. 5,200,234, the disclosure of which is hereby expressly incorporated by reference, that diluents can be used to treat cables from the outside in. This prior art teaches that since there is such a gross oversupply of fluid in the annulus of the conduit contemplated in that disclosed method, that dilution is an economic requirement for outside-in treatment to be feasible. The prior art did not consider supersaturation an issue. The TU failure is an unexpected result of an inside-out injection.

SUMMARY OF THE INVENTION

The present invention involves the dilution of the active ingredient, i.e., the "dielectric enhancement fluid" or "anti-treeing agent", used in treating cables having a high ratio of conductor interstitial volume ($v_1$) to conductor shield solubility plus insulation solubility plus insulation shield solubility ($v_2$). A diluent material is selected so as to be substantially insoluble in the polymeric insulation, sufficiently low in initial viscosity to enable introduction into the cable interior, and to miscible with the dielectric enhancement fluid.

In the preferred enhancement of the invention, a method is provided for enhancing the dielectric properties of an electrical cable having a central stranded conductor encased in a polymeric insulation The cable defines an interstitial void space ($v_1$) between the strands of the conductor. The method entails determining a volume ($v_2$) of a dielectric enhancement fluid required to be absorbed by the cable to reach a predetermined level of dielectric enhancement. The ratio of $v_1/v_2$ is computed. If $v_1/v_2$ is greater than a predetermined maximum ratio, then the dielectric enhancement fluid is diluted with a sufficient quantity of a diluent to produce a mixture of diluent and dielectric enhancement fluid, such that when the volume $v_1$ of the mixture is introduced into the cable, the cable will have been supplied with a volume ($v_3$) of the dielectric enhancement fluid wherein $v_3/v_2$ is less than the predetermined maximum ratio. This mixture is then introduced into the cable to substantially fill the volume $v_1$. The predetermined maximum ratio of interstitial cable volume to volume of dielectric enhancement fluid required for a desired predetermined level of treatment ($v_1/v_2$) is preferably no greater than 2.0, still more preferably no greater than 1.6, even more preferably is greater no than 1.4, and most preferably, is within a range of 1.3 to 1.4. The present invention thus provides a method of utilizing diluents to enhance the performance of dielectric enhancement treatment where there is a danger of supersaturation, particularly, in large diameter cables.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIG. 1 is a cable field report for an electrical cable that experienced failure due to the supersaturation that preferred embodiments of the present invention address;

FIG. 3 is a cable geometry data sheet providing interstitial volume parameters for a representative cable suitable for treatment in accordance with the present invention.

DETAILED DESCRIPTION OF THE PREFERRED EMBODIMENT

Figure 2:
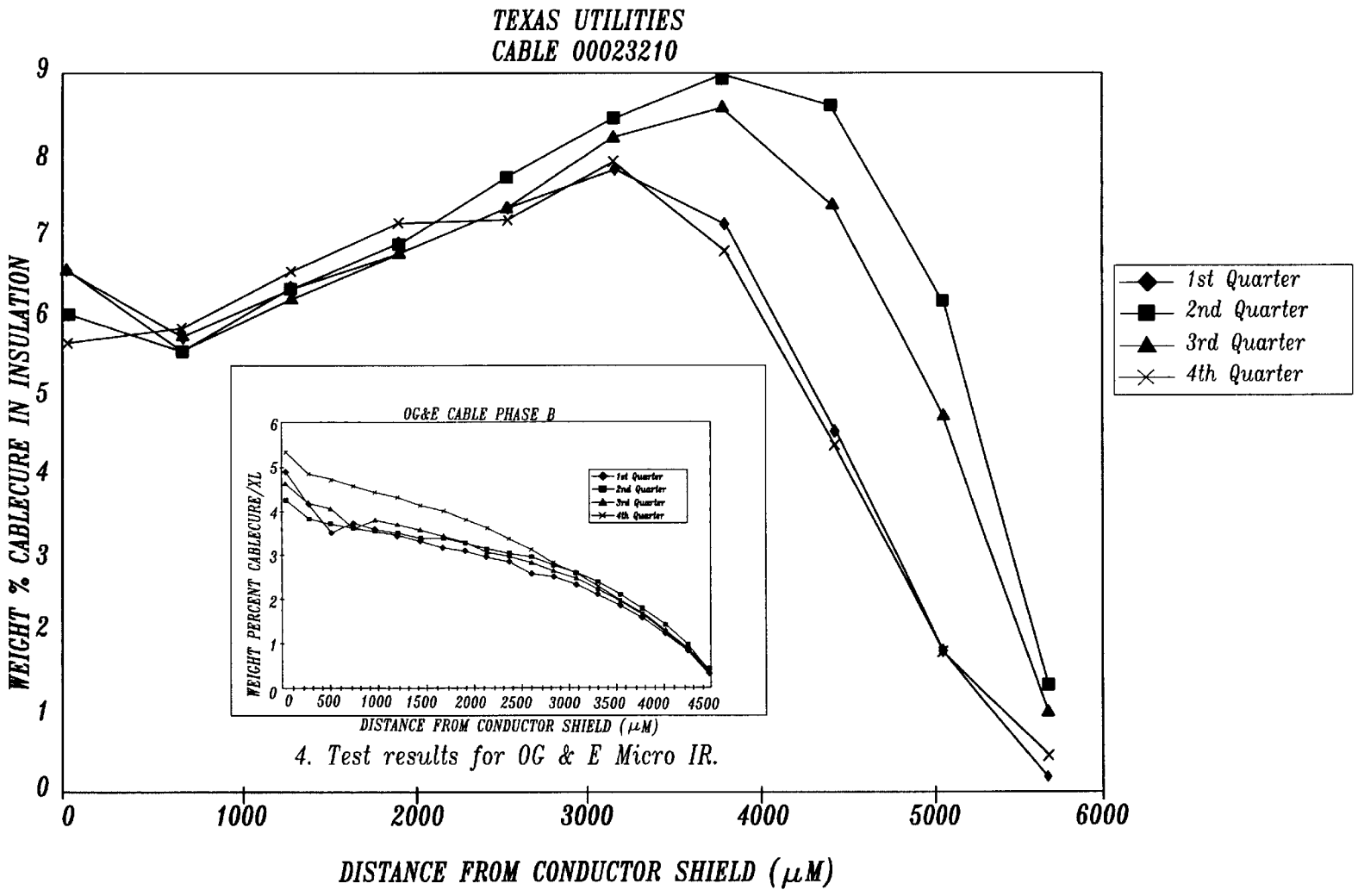
FIG. 2 provides a large chart showing the results of micro-infrared spectrographic analysis of the supersaturated electrical cable documented in FIG. 1, with a smaller inset chart of a treated electrical cable that has not experienced supersaturation for comparison.

The present invention involves the dilution of the dielectric enhancement fluid in treating cables, having a high ratio of stranded conductor interstitial volume to conductor shield plus insulation solubility, with a diluent material.

The present inventions provides a method of treating electrical distribution cables for dielectric enhancement. In a preferred embodiment, underground electrical distribution cables are treated after insulation. However, the present invention may also be adapted for use in the treatment of new cables prior to installation. Other types of electrical cables, such as submarine cables, may also be advantageously treated in accordance with the present invention. While the present invention is primarily directed to treatment of stranded conductor electrical cables, including a plurality of strands defining an interstitial volume $v_1$, the present invention may also be adapted for treatment of cables having a solid conductor core which defines instead a volume $v_1$ between the polymeric insulation jacket and the conductor.

As used herein, the term "large diameter cable" refers to a cable having an area that is computed to be greater than 250 kcm, i.e., greater than 120 $mm^2$. While useful for cables greater than 250 kcm (a unit of area denoting one thousand circular mils), the present invention has particular utility for treatment of cables greater than 500 kcm (120 $mm^2$) in area.

The term "dielectric enhancement fluid" is intended to mean any of a variety of known anti-treeing agents or other anti-treeing agents that may be specifically developed for dielectric enhancement of electrical cable insulation. Suitable anti-treeing agents for use in practicing the present invention include, without limitation, the aromatic radical containing silanes disclosed in U.S. Pat. No. 4,766,011 to Vincent et al., including phenyltrimethoxysilane and phenylmethyidimethoxysilane; and the organosilanes disclosed in U.S. Pat. No. 5,372,841 to Kleyer et al., including phenyltrimethoxysilane, diphenyldimethoxysilane, phenylmethyldiethoxysilane and phenylmethyldimethoxysilane.

The term "diluent" is intended to refer to a material that is at least initially fluid and that has a sufficiently low viscosity to facilitate injection into a cable; that is substantially insoluble in the polymeric insulation materials that are utilized in electrical cables; that are compatible with electrical cable materials and accessories, without causing degradation thereof; and that is miscible with the dielectric enhancement fluids selected.

Preferably diluents have an initial viscosity that is less than 500 cps, and more preferably that is less than 10 cps. While low initial viscosity is necessary, and diluents that stay liquid are suitable, preferred diluents are selected such that the diluent increases in viscosity or even gels during a predetermined period of time after injection into the cable, such as with in 24 hours after injection. This reduces the likelihood and impact of spills from accidental cutting of a treated cable.

A preferred diluent is substantially insoluble in the insoluble polymeric insulation materials used in electrical cables. For conventional insulation materials, i.e., polyethylene and variants such as ultrahigh molecular weight polyethylene, the diluent preferably has a solubility of less than 1.0 weight per cent, and more preferably less than 0.1 weight percent. For other polymeric insulation materials including EPR and EPDM elastomers, a solubility of less than 1.0 weight percent is suitable.

It is also preferred that diluents used in the present invention be environmentally benign, have a flash point that is greater than or equal to the flash point of the dielectric enhancement fluid with which the diluent is to be mixed, and which is toxicologically benign.

The silicone water block fluid sold commercially by Utilx of Kent, Wash. CableCURE/CB™ (as disclosed in U.S. Pat. Nos. 4,845,309, issued to Vincent et al., and 4,961,961, issued to Vincent et al., the disclosures of which are hereby expressly incorporated by reference) meets all of the criteria above and is most preferred for use in the present invention. Other suitable diluents for use in the practice of the present invention include the silicone water block fluids disclosed in U.S. Pat. No. 4,845,309 to Vincent et al., the disclosure of which is hereby incorporated by reference. Still other suitable diluents are disclosed in U.S. Pat. No. 5,200,234 to Bertini, the disclosure of which is hereby incorporated by reference. These diluents include polydimethylsiloxane oil, fluorosilicone oil, mineral oil, and certain high molecular weight vegetable oils. Diluents similar to these materials are also encompassed within the scope of the present invention providing they meet the requirements set forth above with respect to low initial viscosity, low polymeric insulation solubility, compatibility with cable materials and accessories, and miscibility with the dielectric enhancement fluid.

The present invention is adapted for use with large diameter cables. In order to determine whether the present invention is advantageous for use in treating a particular cable, the interstitial void space ($v_1$) between the strands of the conductor core is computed. Based on experience and empirical data, the volume ($v_2$) of dielectric enhancement fluid required to optimally treat the cable to achieve a predetermined level of dielectric enhancement is then determined. Volume $v_2$ is thus the amount of dielectric enhancement fluid that will be absorbed by the polymeric insulation and shield materials. The ratio of interstitial volume to required dielectric enhancement fluid treatment volume ($v_1/v_2$) is then computed. If this volume $v_1/v_2$ is above a predetermined maximum threshold, then the dielectric enhancement fluid is diluted with a diluent in accordance with the present invention prior to application to the cable. This predetermined maximum ratio of $v_1/v_2$ is preferably no greater than 2.0, more preferably no greater than 1.6, still more preferably no greater than 1.4 and most preferably is between 1.3 and 1.4. Larger ratios above 1.4 may be preferred in certain instances, however, such as when a low temperature fluctuation during use is anticipated, or when a high degree of materials intended to diffuse through the cable insulation ("fugitive" materials) are included in the dielectric enhancement fluid.

When the ratio of $v_1/v_2$ is greater than the predetermined maximum threshold, then a sufficient quantity of diluent is added to the dielectric enhancement fluid, either prior to or during introduction into the cable interior, to produce a mixture of diluent and dielectric enhancement fluid. Sufficient diluent is added such that when the volume $v_1$ of the mixture is supplied to the cable interior (substantially filling the interstitial void space), the cable will have been supplied with a net volume ($v_3$) of the dielectric enhancement fluid (not including the diluent), wherein ($v_3/v_2$) is less than the predetermined ratio. Preferably, the mixing of this solution is carried out and is followed by introduction of the mixture to the cable interior. If the preferred diluent disclosed above is utilized, after introduction, the diluent gels within the cable interior while the dielectric enhancement fluid diffuses into the polymeric insulation and shield materials of the cable.

As a representative example, FIG. 3 is a Cable Geometry Data Sheet for the TU cable. The section of Attachment 3 labeled "Mass Absorption, Silicone" indicates that 14.283 pounds of dielectric enhancement fluid will be absorbed by the cable's conductor shield, 14.837 pounds of fluid will be absorbed by the polymeric insulation jacket, and 0.946 pounds of fluid will be absorbed by the insulation shield for proper treatment, or a ($v_2$) total of 30 pounds. The interstitial volume ($v_1$) is about 70 pounds. Hence the ratio of interstitial volume to that required for treatment ($v_1/v_2$) is 70/30 or 2.33.

Because this ratio is in excess of the predetermined measurement ratio, in this case 1.4, dilution back to a ratio of dielectric enhancement fluid contained in the diluted mixture to interstitial void space of 1.4 is required to eliminate the possibility of supersaturation.

Excess dilution is to be avoided. For example, a ratio of 1.0 is not desirable since some fluid diffuses all of the way out of the cable and there must be some residual fluid in the strands within the diluent in order to provide sufficient free energy (an entropy driving force) to allow diffusion into the conductor shield. Preferably, there should be at least the same concentration of the remaining fluid in the diluent as can be absorbed/adsorbed in the strand shield, which is typically 16%. Hence the optimum ratio ($v_3/v_2$) is between 1.3 and 1.4.

For any cables with a treatment ratio greater than 1.4 (or other predetermined ratio as determined herein), dilution back to 1.3 to 1.4 is desired for reliable post-treatment dielectric performance. Table 1 provides some examples of cable sizes and their ratio of interstitial volume to fluid requirements sorted by this ratio. The headings in this table are abbreviated as follows: AWG—American Wire Gage; mils—thickness of insulation in mils; Cd—cable code; kV—electrical rating in kV; str.—strand count; Inter.—interstitial volume; and required volume of fluid absorbed for treatment. A horizontal line is drawn between those cables with ratios less than 1.4 and those with ratios greater than 1.4. All cables, that have a treatment ratio in excess of 1.4 would benefit from treatment in accordance with the preferred embodiment of the present invention.

The preferred embodiment of the present invention provides that dilution in cables with $v_1/v_2$ ratios in excess of 1.4 will improve the reliability of treated cables.

TABLE 1

Ratio of Interstitial Volume to Volume Required for Treatment

| AWG. | mils | Cd | kV. | Str. | $v_1$ (Inter.) | $v_1$ (Required) | Ratio |
|---|---|---|---|---|---|---|---|
| NO.2 | 420 | 00 | 35 | 7 | 1.0 | 19.912 | 0.050 |
| NO.2 | 345 | 00 | 35 | 7 | 1.0 | 15.392 | 0.064 |
| NO.2 | 320 | 00 | 25 | 7 | 1.0 | 14.020 | 0.070 |
| NO.2 | 295 | 00 | 25 | 7 | 1.0 | 12.716 | 0.078 |
| NO.2 | 260 | 00 | 25 | 7 | 1.0 | 11.004 | 0.090 |
| NO.4 | 220 | 00 | 15 | 7 | 0.8 | 8.846 | 0.095 |
| M016 | 197 | 00 | 20 | 7 | 0.5 | 5.335 | 0.096 |
| NO.2 | 220 | 00 | 15 | 7 | 1.0 | 9.210 | 0.107 |
| 1/0 | 280 | 01 | 25 | 7 | 1.6 | 14.039 | 0.114 |
| NO.4 | 175 | 00 | 15 | 7 | 0.8 | 7.256 | 0.116 |
| NO.2 | 175 | 01 | 15 | 7 | 1.0 | 7.661 | 0.125 |
| M035 | 175 | 00 | 10 | 7 | 0.9 | 6.792 | 0.131 |
| NO.2 | 175 | 00 | 15 | 7 | 1.0 | 7.662 | 0.137 |
| NO.2 | 175 | 02 | 15 | 7 | 1.0 | 7.477 | 0.139 |
| 1/0 | 220 | 02 | 15 | 7 | 1.5 | 9.840 | 0.151 |
| 1/0 | 175 | 01 | 15 | 7 | 1.6 | 9.022 | 0.176 |
| 4/0 | 580 | 00 | 46 | 19 | 9.7 | 53.121 | 0.182 |
| NO.1 | 420 | 00 | 35 | 19 | 4.2 | 20.862 | 0.200 |
| 1/0 | 420 | 00 | 35 | 19 | 5.2 | 22.225 | 0.236 |
| NO.1 | 345 | 00 | 35 | 19 | 4.2 | 16.188 | 0.257 |
| 500 | 900 | 00 | 138 | 37 | 29.9 | 114.603 | 0.261 |
| 2/0 | 420 | 00 | 35 | 19 | 6.6 | 23.670 | 0.280 |
| NO.1 | 320 | 00 | 25 | 19 | 4.2 | 14.765 | 0.282 |
| 1/0 | 345 | 00 | 35 | 19 | 5.2 | 17.380 | 0.302 |
| 3/0 | 420 | 00 | 35 | 19 | 8.3 | 25.346 | 0.329 |
| 1/0 | 320 | 00 | 25 | 19 | 5.2 | 15.900 | 0.330 |
| 2/0 | 345 | 00 | 35 | 19 | 6.6 | 18.650 | 0.355 |
| NO.1 | 260 | 00 | 25 | 19 | 4.2 | 11.625 | 0.358 |
| 1/0 | 295 | 00 | 25 | 19 | 5.2 | 14.488 | 0.362 |
| 4/0 | 420 | 00 | 35 | 19 | 10.5 | 27.297 | 0.385 |
| 2/0 | 320 | 00 | 25 | 19 | 6.6 | 17.112 | 0.387 |
| 250 | 525 | 00 | 69 | 37 | 15.8 | 39.256 | 0.401 |

TABLE 1-continued

Ratio of Interstitial Volume to Volume Required for Treatment

| AWG. | mils | Cd | kV. | Str. | $v_1$ (Inter.) | $v_1$ (Required) | Ratio |
|---|---|---|---|---|---|---|---|
| 500 | 620 | 00 | 49 | 37 | 29.3 | 72.278 | 0.406 |
| 3/0 | 345 | 00 | 35 | 19 | 8.3 | 20.127 | 0.415 |
| 1/0 | 260 | 00 | 25 | 19 | 5.2 | 12.624 | 0.415 |
| NO.1 | 220 | 00 | 15 | 19 | 4.2 | 9.749 | 0.427 |
| 3/0 | 320 | 00 | 25 | 19 | 8.3 | 18.523 | 0.451 |
| 750 | 800 | 00 | 115 | 61 | 44.8 | 96.698 | 0.463 |
| 4/0 | 345 | 00 | 35 | 19 | 10.5 | 21.851 | 0.481 |
| 2/0 | 260 | 00 | 25 | 19 | 6.6 | 13.697 | 0.483 |
| 1/0 | 220 | 00 | 15 | 19 | 5.4 | 10.848 | 0.498 |
| 1000 | 880 | 00 | 99 | 61 | 72.2 | 142.467 | 0.507 |
| 4/0 | 320 | 00 | 25 | 19 | 10.5 | 20.171 | 0.521 |
| NO.1 | 175 | 00 | 15 | 19 | 4.2 | 7.845 | 0.531 |
| M240 | 510 | 00 | 60 | 61 | 29.1 | 54.752 | 0.532 |
| 250 | 420 | 00 | 35 | 37 | 15.8 | 28.507 | 0.553 |
| 3/0 | 260 | 00 | 25 | 19 | 8.3 | 14.949 | 0.558 |
| 2/0 | 220 | 00 | 15 | 19 | 6.6 | 11.637 | 0.569 |
| 1/0 | 175 | 00 | 15 | 19 | 5.2 | 8.651 | 0.606 |
| M095 | 200 | 00 | 20 | 19 | 8.2 | 13.376 | 0.616 |
| 4/0 | 260 | 00 | 25 | 19 | 10.5 | 16.415 | 0.641 |
| 3/0 | 220 | 00 | 15 | 19 | 8.3 | 12.783 | 0.653 |
| M070 | 216 | 00 | 20 | 19 | 7.0 | 10.241 | 0.679 |
| 350 | 420 | 00 | 35 | 37 | 22.1 | 32.112 | 0.688 |
| 250 | 345 | 00 | 35 | 37 | 15.8 | 22.875 | 0.689 |
| 2/0 | 175 | 00 | 15 | 19 | 6.6 | 9.526 | 0.695 |
| 4/0 | 220 | 00 | 15 | 19 | 10.5 | 14.128 | 0.744 |
| 250 | 320 | 00 | 25 | 37 | 15.8 | 21.133 | 0.746 |
| M120 | 227 | 00 | 20 | 37 | 12.6 | 16.653 | 0.758 |
| 1973 | 880 | 01 | 99 | 61 | 117.4 | 149.861 | 0.784 |
| 3/0 | 175 | 00 | 15 | 19 | 8.3 | 10.552 | 0.791 |
| 350 | 345 | 00 | 35 | 37 | 22.1 | 26.061 | 0.847 |
| 500 | 420 | 00 | 35 | 37 | 31.5 | 36.775 | 0.856 |
| 4/0 | 175 | 00 | 15 | 19 | 10.6 | 12.302 | 0.861 |
| 1750 | 880 | 01 | 99 | 127 | 131.6 | 148.875 | 0.884 |
| 350 | 320 | 00 | 25 | 37 | 22.1 | 24.180 | 0.913 |
| 250 | 260 | 00 | 25 | 37 | 15.8 | 17.227 | 0.915 |
| M065 | 135 | 00 | 11 | 19 | 5.3 | 5.747 | 0.918 |
| M380 | 440 | 00 | 88 | 61 | 44.4 | 46.236 | 0.961 |
| M240 | 195 | 01 | 15 | 19 | 23.4 | 22.777 | 1.029 |
| 500 | 345 | 00 | 35 | 37 | 31.5 | 30.205 | 1.043 |
| 250 | 220 | 00 | 15 | 37 | 15.8 | 14.840 | 1.062 |
| 300 | 160 | 00 | 10 | 37 | 12.7 | 11.653 | 1.089 |
| 350 | 260 | 00 | 25 | 37 | 22.1 | 19.940 | 1.107 |
| 500 | 320 | 00 | 25 | 37 | 31.5 | 28.151 | 1.119 |
| 750 | 420 | 00 | 35 | 61 | 52.6 | 42.910 | 1.225 |
| 350 | 220 | 00 | 15 | 37 | 22.1 | 17.330 | 1.274 |
| 250 | 175 | 00 | 15 | 37 | 15.8 | 12.362 | 1.275 |
| M240 | 235 | 00 | 20 | 61 | 28.9 | 22.616 | 1.279 |
| 500 | 260 | 00 | 25 | 37 | 31.5 | 23.495 | 1.340 |
| 600 | 260 | 00 | 35 | 37 | 31.5 | 23.471 | 1.342 |
| 1500 | 420 | 00 | 46 | 91 | 116.1 | 82.494 | 1.408 |
| M325 | 266 | 01 | 23 | 61 | 44.0 | 30.748 | 1.432 |
| M325 | 266 | 02 | 23 | 61 | 44.0 | 29.991 | 1.468 |
| 750 | 345 | 00 | 35 | 61 | 52.6 | 35.614 | 1.476 |
| M120 | 197 | 01 | 20 | 7 | 21.9 | 14.577 | 1.503 |
| M325 | 260 | 99 | 23 | 61 | 43.9 | 29.138 | 1.508 |
| 350 | 175 | 00 | 15 | 37 | 22.1 | 14.601 | 1.512 |
| 500 | 220 | 00 | 15 | 37 | 31.5 | 20.608 | 1.528 |
| 750 | 260 | 00 | 25 | 61 | 42.5 | 27.621 | 1.537 |
| 750 | 220 | 01 | 15 | 61 | 44.1 | 28.220 | 1.562 |
| 750 | 320 | 00 | 25 | 61 | 52.6 | 33.318 | 1.577 |
| 750 | 260 | 01 | 25 | 61 | 49.8 | 30.849 | 1.616 |
| 1000 | 345 | 00 | 35 | 61 | 70.0 | 40.769 | 1.717 |
| 600 | 220 | 00 | 15 | 37 | 31.9 | 18.236 | 1.751 |
| 500 | 175 | 00 | 15 | 37 | 31.5 | 17.776 | 1.771 |
| 1000 | 320 | 00 | 25 | 61 | 70.0 | 38.271 | 1.829 |
| 750 | 220 | 00 | 15 | 61 | 50.8 | 26.153 | 1.941 |
| 750 | 175 | 00 | 15 | 61 | 51.1 | 25.001 | 2.046 |
| M400 | 145 | 00 | 10 | 61 | 45.2 | 21.140 | 2.138 |
| 1000 | 260 | 00 | 25 | 61 | 70.0 | 32.551 | 2.151 |
| 1500 | 420 | 01 | 46 | 91 | 149.5 | 64.403 | 2.321 |
| 1000 | 175 | 00 | 15 | 61 | 70.0 | 30.066 | 2.328 |
| 1000 | 175 | 01 | 15 | 61 | 67.4 | 28.651 | 2.351 |
| 1000 | 220 | 00 | 15 | 61 | 70.0 | 28.954 | 2.418 |
| 750 | 380 | 00 | 46 | 61 | 75.0 | 30.307 | 2.474 |

TABLE 1-continued

Ratio of Interstitial Volume to Volume Required for Treatment

| AWG. | mils | Cd | kV. | Str. | $v_1$ (Inter.) | $v_1$ (Required) | Ratio |
|---|---|---|---|---|---|---|---|
| M800 | 175 | 00 | 20 | 91 | 113.5 | 39.243 | 2.892 |
| 1500 | 220 | 00 | 46 | 127 | 102.9 | 29.740 | 3.461 |
| 560 | 100 | 01 | 5 | 37 | 51.4 | 5.182 | 9.923 |

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method for enhancing the dielectric properties of an electrical cable having a central stranded conductor encased in a polymeric insulation, the cable defining an interstitial void space ($v_1$) between the strands of the conductor, comprising:

(a) determining a volume ($v_2$) of a dielectric enhancement fluid to be absorbed by the cable to reach a predetermined level of dielectric enhancement;

(b) computing the ratio of ($v_1/v_2$) for the cable;

(c) if ($v_1/v_2$) is greater than a predetermined maximum ratio determined to avoid supersaturation of the polymeric dielectric enhancement fluid after treatment and during long-term use, then diluting a quantity of the dielectric enhancement fluid with a sufficient quantity of a diluent to produce a mixture of diluent and dielectric enhancement fluid, such that when the volume ($v_1$) of the mixture is introduced into the cable, the cable will have been supplied with a volume ($v_3$) of the dielectric enhancement fluid within the mixture such that the ratio ($v_3/v_2$) is less than a predetermined maximum ratio of 2.0; and (d) introducing the mixture into the cable.

2. The method of claim 1, wherein the predetermined maximum ratio is 1.6.

3. The method of claim 1, wherein the predetermined maximum ratio is 1.4.

4. The method of claim 3, wherein sufficient diluent is added such that the ratio ($v_3/v_2$) is at least 1.3 and less than 1.4.

5. The method of claim 1, wherein sufficient diluent is added such that the ratio ($v_3/v_2$) is at least a predetermined minimum ratio.

6. The method of claim 1, wherein the dielectric enhancement fluid comprises an organosilane.

7. The method of claim 1, wherein the diluent comprises a silicone water block fluid that thickens or gels within a predetermined time after introduction into the cable interior.

8. The method of claim 1, wherein the diluent is selected from the group consisting of a silicone water block fluid, a polydimethylsiloxane oil, a fluorosilicone oil, a mineral oil, and a vegetable oil.

9. A method for enhancing the dielectric properties of an electrical cable having a central conductor encased in a polymeric insulation, the cable defining an interstitial void space ($v_1$) between the conductor and the polymeric insulation, comprising:

(a) determining a volume ($v_2$) of a dielectric enhancement fluid to be absorbed by the cable to reach a predetermined level of dielectric enhancement;

(b) computing the ratio of ($v_1/v_2$) for the cable;

(c) if $(v_1/v_2)$ is greater than a predetermined maximum ratio determined to avoid supersaturation of the polymeric dielectric enhancement fluid after treatment and during long-term use, then diluting a quantity of the dielectric enhancement fluid with a sufficient quantity of a diluent to produce a mixture of diluent and dielectric enhancement fluid, such that when the volume $(v_1)$ of the mixture is introduced into the cable, the cable will have been supplied with a volume $(v_3)$ of the dielectric enhancement fluid within the mixture such that the ratio $(v_3/v_2)$ is less than the predetermined maximum ratio; and (d) introducing the mixture into the cable.

* * * * *